US005255495A

United States Patent [19]

Kovacs

[11] Patent Number: 5,255,495

[45] Date of Patent: Oct. 26, 1993

[54] ADJUSTABLE GIRTH FORMER

[75] Inventor: Lloyd Kovacs, Sheboygan, Wis.

[73] Assignee: Hayssen Manufacturing Company, Sheboygan, Wis.

[21] Appl. No.: 969,751

[22] Filed: Oct. 30, 1992

[51] Int. Cl.[5] ..... B65B 9/06; B65B 9/22; B65B 5/06

[52] U.S. Cl. ..... 53/504; 53/550

[58] Field of Search ..... 53/550, 551, 552, 450, 53/66, 504

[56] References Cited

U.S. PATENT DOCUMENTS

| | | | |
|---|---|---|---|
| 3,872,644 | 3/1975 | Giraudi et al. | 53/504 X |
| 4,430,844 | 2/1984 | James | 53/550 X |
| 4,519,185 | 5/1985 | Horn et al. | 53/550 |
| 4,679,379 | 7/1987 | Cassoli | 53/550 X |
| 4,909,356 | 3/1990 | Rimondi et al. | 53/66 X |
| 4,958,477 | 9/1990 | Winkler | 53/550 X |
| 5,113,635 | 5/1992 | Takai et al. | 53/550 X |
| 5,165,221 | 11/1992 | Udelson et al. | 53/550 |
| 5,177,935 | 1/1993 | Jones et al. | 53/550 X |

*Primary Examiner*—Horace M. Culver
*Attorney, Agent, or Firm*—Lee, Mann, Smith, McWilliams, Sweeney & Ohlson

[57] ABSTRACT

An adjustable girth control for the tube former in a packaging machine for encapsulating individual rolls or groups of rolls in a film. The tube former includes a forming body which is shaped to envelope the product passing therethrough and which has opposite adjustable forming elements with a variable gap between them. The forming elements are shifted horizontally and vertically to vary internal dimensions of the forming body to accommodate rolls of different diameters. Shifting can occur manually or automatically responsive to detection of the sizes of incoming rolls.

15 Claims, 6 Drawing Sheets

ADJUSTABLE GIRTH FORMER

BACKGROUND OF THE INVENTION

This invention relates to machines for packaging rolls or groups of rolls in a film, and in particular to an adjustable girth control for a tube former in such machines.

In modern packaging machinery, rolled products, such as rolls of toilet tissue or paper towels, are conveyed individually or in groups, encapsulated in a plastic film formed into a tube, and the tube is then severed between succeeding products and sealed into individual packages. A basic packaging machine is illustrated and described in U.S. Pat. No. 4,430,844, which is assigned to the same assignee as the present application, and the disclosure of which is incorporated herein by reference.

In such machines, a girth former is included for forming plastic film into a tube extending about the products to be wrapped. The girth former is sized specifically to take into account the diameter and softness of the product being wrapped. Depending on softness or hardness of the product, diameter variations can occur, but those variations are limited by the sizing of the girth former. Therefore, diameter variations can cause serious production problems, particularly with harder-wrapped rolls which cannot compress sufficiently. The result is that such rolls may be too loosely wrapped with the plastic film, or the rolls may actually jam in the girth former, causing the machine to be shut down while the jam is cleared.

In the typical packaging machine such as depicted in incorporated U.S. Pat. No. 4,430,844, product is introduced into the area of the girth former and is conveyed into place, often being somewhat compressed by an upstream preformer section before entering the girth former. Often, the compression set in the preformer compresses the rolls somewhat more than necessary to enter the girth former to insure that the rolls properly enter the former without interference or jamming. As the rolls enter the girth former, they are encapsulated in a tube of film, and are also contacted by pull belts which move in unison with the product and the tube, ensuring a smooth transfer for downstream sealing.

Whenever a different product is to be packaged by the machine, the girth former must be changed. That change also requires adjustment of the preformer and realignment of the pull belts to ensure that product travels smoothly through the girth forming area.

The amount of film wrapped about the product traveling through the machine is dictated by the internal dimension of the girth former, and not by the size of the product itself. Therefore, if the product is smaller in diameter than intended, a loose wrap will result, which is undesirable. To overcome this problem, and to accommodate varying diameters of product traveling through the machine, an adjustable girth former is needed.

SUMMARY OF THE INVENTION

The invention pertains to an adjustable girth control for a tube former in a packaging apparatus in which products comprising individual rolls or groups of rolls are conveyed serially and are packaged in a film. The tube former is situated to continuously form a sheet of film into a tube which encapsulates succeeding product, and the adjustable girth control includes a forming body in the tube former, the forming body being shaped to envelope product passing therethrough. The forming body has opposite adjustable forming elements and has a variable gap between the forming elements to accommodate the adjustment of the elements. Means is provided, secured to the forming elements, for shifting the forming elements to vary the internal dimensions of the forming body.

In accordance with the preferred form of the invention, each forming element comprises a section of the forming body, and the shifting means includes means for both horizontally displacing the two sections and vertically displacing the two sections. The horizontal displacing means comprises a slide assembly having a slide element secured to each forming body's section. It also includes means for drawing the slide elements toward and away from one another to vary the gap.

In this form of the invention, the means for drawing the slide elements toward and away from one another comprises a threaded bore in each slide element. The bores are formed in alignment with one another and the threading in one bore is formed opposite to the threading in the other bore. A threaded rod is engaged in the bores, with the rod having threading complementary to the threading in the bores.

Means is provided for rotating the rod to draw the sections toward and away from one another. In the preferred form of the invention, the rotating means comprises a rotary actuator, and the invention further includes means for automatically activating the actuator to rotate the rod. That automatic activating means comprises a processor, with the processor being connected to, and receiving signals from, an upstream sensor which is positioned to sense dimensions of product entering the forming body.

For vertically displacing the sections of the forming body, it is preferred that camming means be employed for raising and lowering the slide elements as the gap is varied. In accordance with one form of the invention, the camming means comprises a pair of spaced, inclined cams, and includes a cam follower in each cam. Each cam follower is secured to an arm, with one arm being affixed to one slide element and the other arm being affixed to the other slide element.

In the preferred form of the invention, a preformer is located at and in alignment with an upstream end of the forming body. The preformer includes a pair of side forming members, and means is provided attached to the side forming members for adjusting the side forming members toward and away from one another. It is preferred that the rotary actuator be used for simultaneously adjusting the side forming members and the two sections of the forming body.

Since the two sections of the forming body move relative to the remaining portion of the forming body, each of the sections is formed extending from a flex location in the forming body. In accordance with the disclosed form of the invention, the flex location comprises a slit formed partially across the forming body.

The gap between the two sections of the forming body dictates the amount of decrease of the internal size of the forming body. It is preferred that the gap be formed in the forming body at an oblique angle to the direction of travel of product through the forming body.

BRIEF DESCRIPTION OF THE DRAWINGS

The invention is described in greater detail in the following description of examples embodying the best mode of the invention, taken in conjunction with the drawing figures, in which.

DESCRIPTION OF THE EXAMPLES EMBODYING THE BEST MODE OF THE INVENTION

Figure 1:
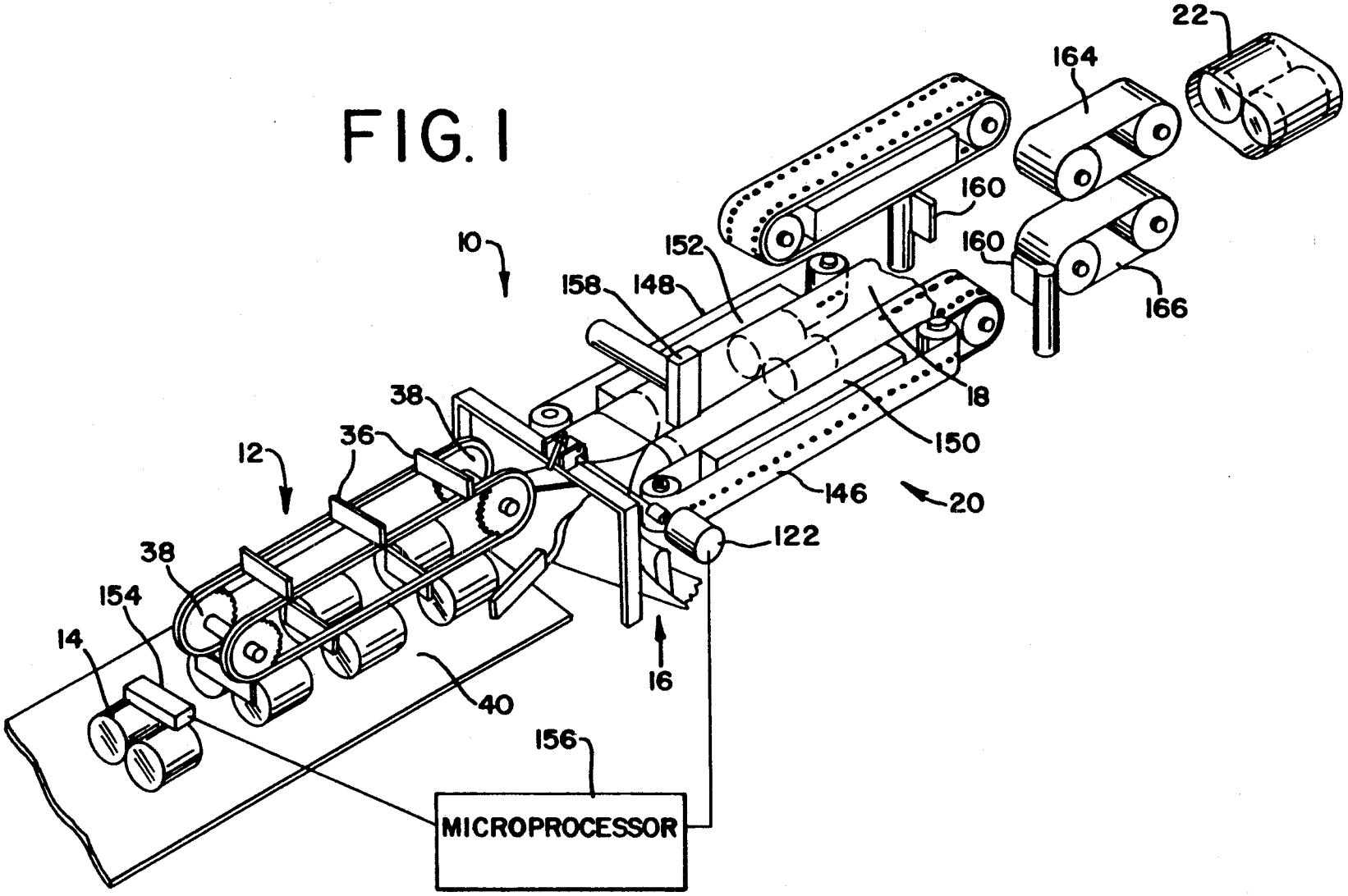
FIG. 1 is a perspective view of the girth forming area of a packaging machine in accordance with the invention, with operative portions being eliminated to better show detail.

A girth forming apparatus and the surrounding operative elements of a packaging machine according to the invention is depioted generally at 10 in FIG. 1. The depioted portions of the packaging apparatus include an overhead conveyor section 12 for conveying rolls 14 in alignment and regularly into an adjustable girth forming apparatus 16, in which the rolls are encapsulated in a plastic film 18. The film and rolls exit the girth forming apparatus 16 in a pull belt section 20. Successive rolls or groups of rolls are then severed while encapsulated in a tubular section of the plastic film to form a partially sealed package 22. Downstream processing seals the ends of the package 22 to complete the packaging process in a conventional fashion.

Figure 2:
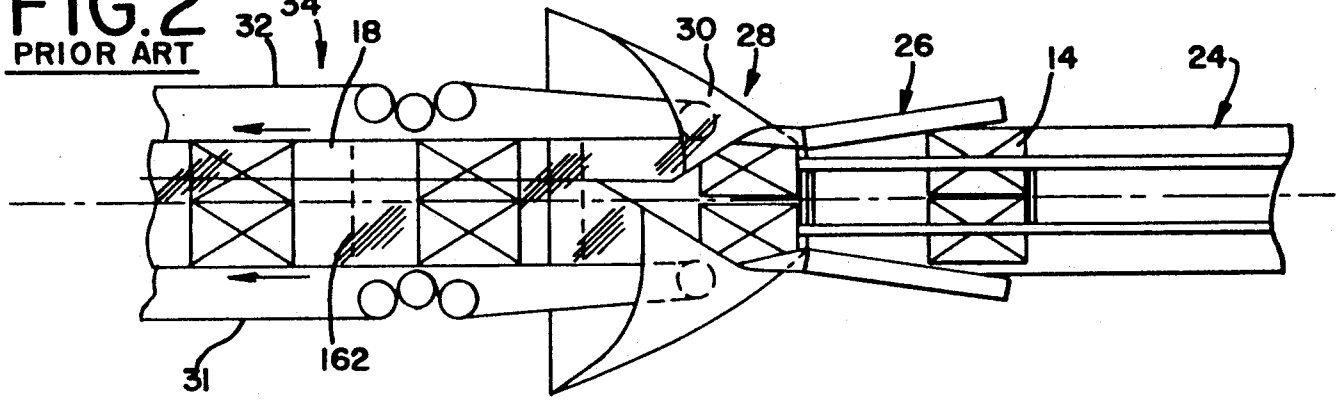
FIG.2 PRIOR ART
FIG. 2 is a top plan view of a girth former of the prior art design, such as that of incorporated U.S. Pat. No. 4,430,844.
Figure 7:
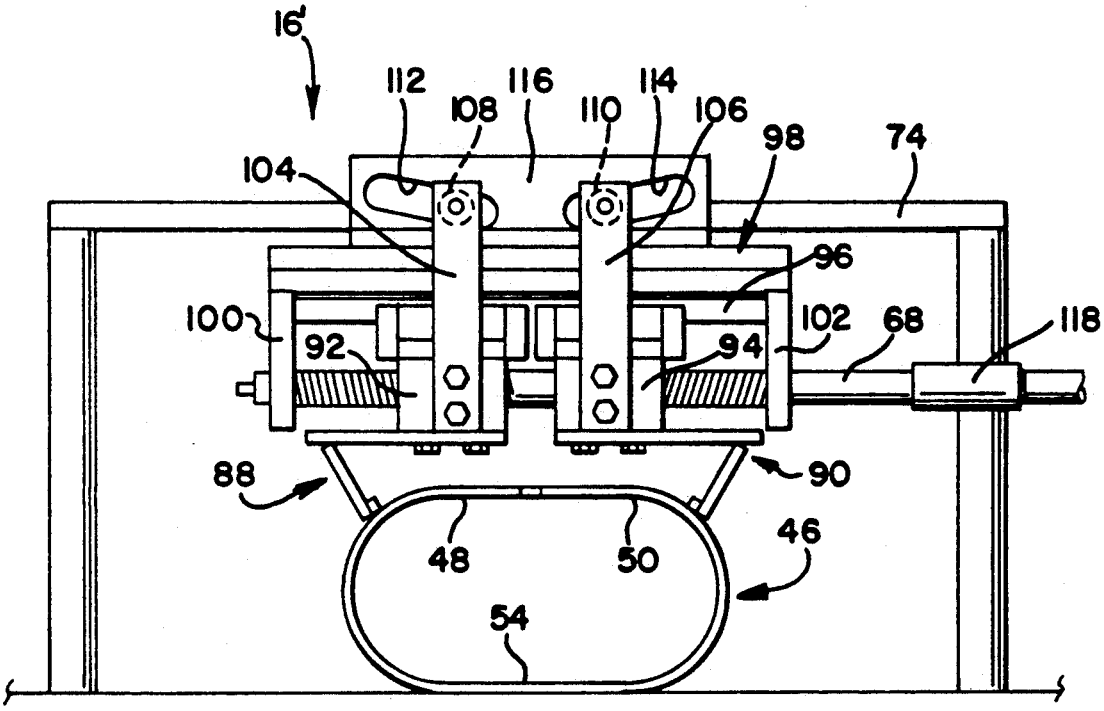
FIG. 7 is a view similar to that of FIG. 6, but further enlarged and of a modified form of the invention.
Figure 8:
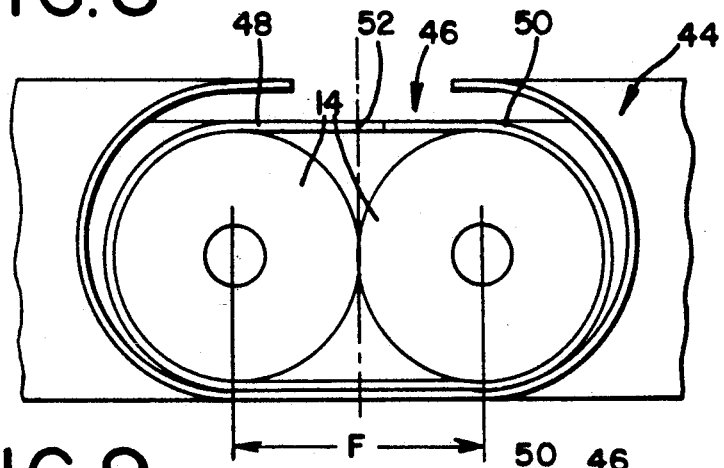
FIG. 8 is a schematic illustration of the invention, looking downstream through the girth former, with a middle adjustment of the gap formed in the adjustable forming body.
Figure 9:
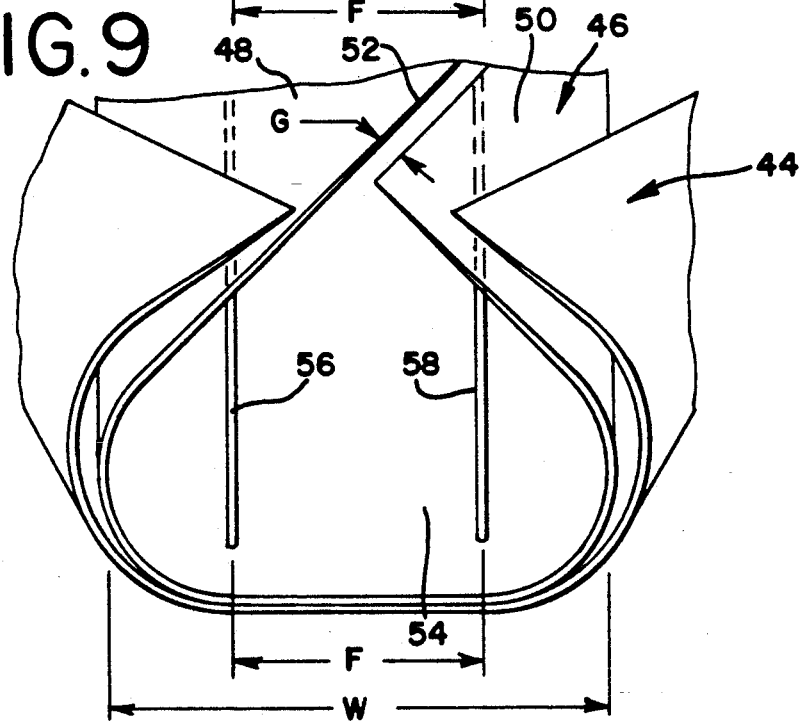
FIG. 9 is a perspective view of FIG. 8, with the product rolls removed.
Figure 10:
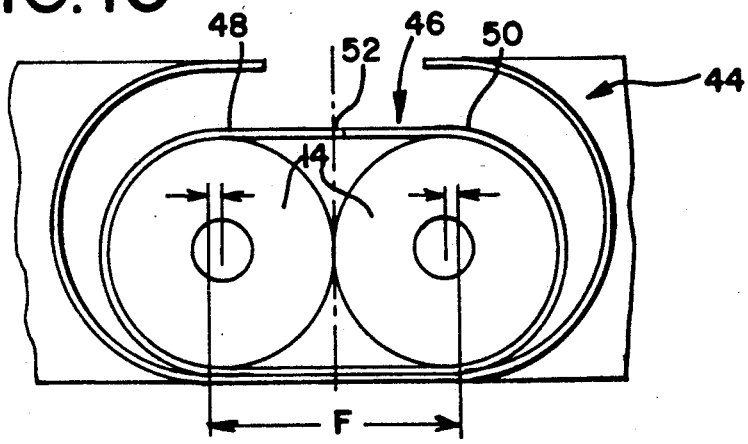
FIG. 10 is a schematic view similar to FIG. 8, but showing a reduced size of the forming body to accommodate rolls of smaller diameters.
Figure 11:
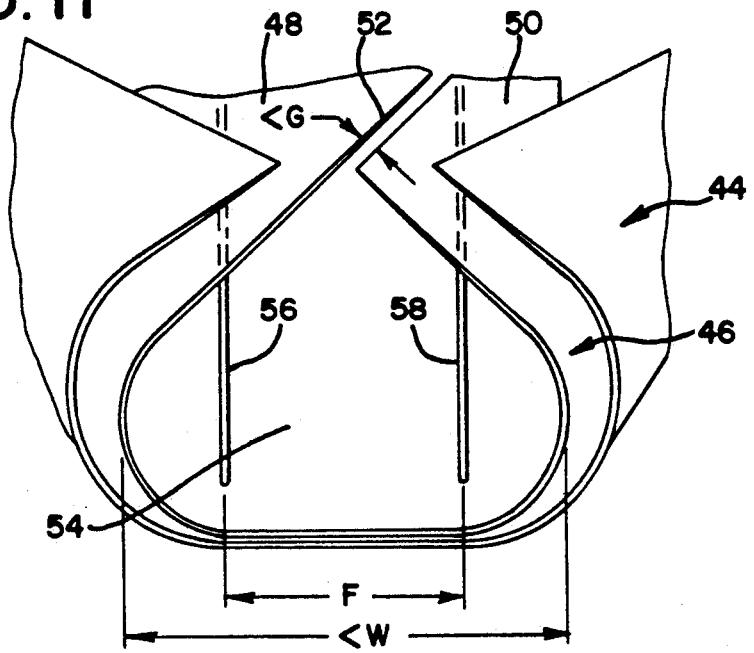
FIG. 11 is a perspective view similar to FIG. 10, but with the product rolls removed and showing the resultant smaller gap in the forming body.
Figure 12:
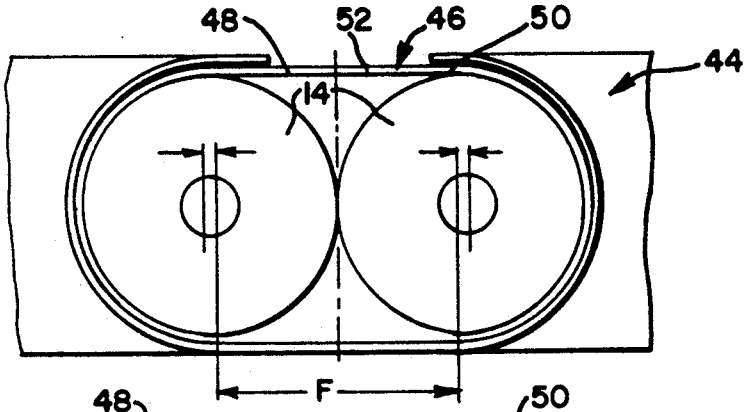
FIG. 12 is a schematic view similar to FIG. 8, but with the forming body expanded to accommodate rolls of a larger diameter.
Figure 13:
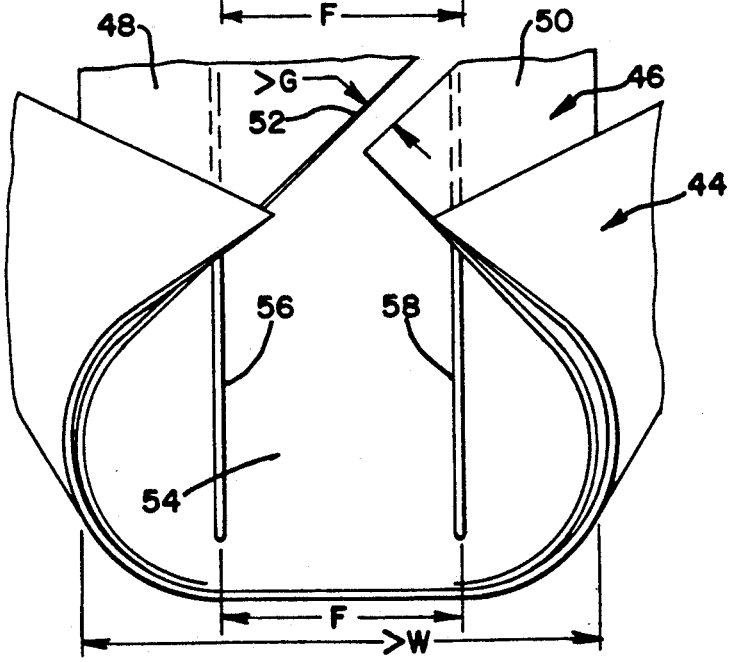
FIG. 13 is a perspective of the adjustment of the apparatus shown in FIG. 12, but with the product rolls removed to illustrate detail and showing the resulting larger gap.

FIG. 2 illustrates a prior art form of the invention, such as that illustrated in Pat. No. 4,430,844. Illustrated is an overhead conveying apparatus 24 leading into a preformer 26 at the mouth of a non-adjustable girth forming apparatus 28. In a conventional fashion, plastic film is guided by a fixed skirt or shoulder 30 into the forming apparatus 28, which forms the film into a tube encapsulating the product 14. Pull belts 31 and 32 of a pull belt section 34 convey the encapsulated product downstream. FIGS. 3 through 6 illustrate one form of the improved girth forming apparatus according to the invention. FIG. 7 illustrates a modification. For the purposes of illustration, not all detail is snown in FIGS. 3 and 4.

The overhead conveying section 12 may be conventional, comprising a series of paddles 36 endlessly revolved about sprockets 38 The paddles align and convey the rolls 14 across a deadplate 40 into the adjustable girth forming apparatus 16.

At the exit end of the conveying section 12 and at the entrance to the girth forming apparatus 16, an adjustable preformer 42 accepts the rolls 14, and compresses the rolls sufficiently to permit easy entry into the girth forming apparatus 16. The preformer 42 and girth forming apparatus 16 are mutually adjustable, as described in greater detail below.

The girth forming apparatus 16 is composed of two primary components, an outer, fixed shoulder 44 and an inner, adjustable forming body 46. The forming body 46 is shaped to envelope the rolls 14 traveling therethrough, and is composed of opposite adjustable forming elements or sections 48 and 50 (best shown in FIGS. 8 through 13), separated by a variable gap 52 extending at on oblique angle to the direction of travel through the forming body 46. A bottom portion 54 of the forming body is fixed, extending between flex boundaries 56 and 58 defining the locations where the respective forming sections 48 and 50 begin. The flex boundaries 56 and 58 preferably comprise longitudinal slits in the material of the forming body 46.

The forming sections 48 and 50 are adjustable toward and away from one another to accommodate varying sizes of rolls 14. As will become evident, the forming sections must be adjusted both horizontally and vertically, those adjustments being best depicted in FIGS. 8, 10 and 12.

The adjustment mechanism of the forming sections 48 and 50 in the version of the invention illustrated in FIGS. 3 through 6 comprises a slide assembly having a first slide element 60 attached to the forming section 48 and a second slide element 62 attached to the forming section 50. Each of the slide elements includes respective blocks 64 and 66 at the tops thereof. Each of the blocks 64 and 66 has an internal threaded bore, the bores being in alignment and engaging a threaded rod 68. The threading of the bores are opposite to one another, and the rod is threaded in a complementary fashion, so that rotation of the rod 68 in one direction will draw the two blocks 64 and 66 toward one another (and thus the forming sections 48 and 50 toward one another), while rotation of the rod 68 in the opposite direction spreads the blocks 64 and 66 (thus spreading the forming sections 48 and 50).

In addition to horizontal adjustment, the slide elements 60 and 62 are vertically adjustable. The blocks 64 and 66 engage an upper track 70. The track 70 is attached to a flat plate 72. A fixed frame 74 extends above the girth forming apparatus 16, and includes horizontal arms 76 and 78 carrying between them a roll 80. The roll 80 is rotatably mounted between the arms 76 and 78, and is rotatable by an actuator assembly 82. The roll 80 is also secured to upstanding brackets 84 and 86 secured to the plate 72. Therefore, by judicious revolution of the roll 80, the plate 72 is raised or lowered, raising or lowering the blocks 64 and 66, and thus the slide elements 60 and 62, raising or lowering the respective forming sections 48 and 50.

A modified form of the girth forming apparatus of the invention is shown in FIG. 7. Similar elements of the invention retain the same reference numerals, and the outer forming shoulder 44 has been eliminated for purposes of clarity and illustration. The girth forming apparatus 16 of FIG. 7 is formed to automatically and simultaneously shift the forming sections 48 and 50 both horizontally and vertically. The respective sections 48 and 50 are secured to slide elements 88 and 90 which are topped by blocks 92 and 94. In the same fashion as the first form of the invention, the blocks 92 and 94 are internally threaded in opposite directions, and are engaged by the rod 68, which is similarly threaded. The blocks 92 and 94 have upper portions engaged on a track 96 secured in a framework 98 which has downwardly depending legs 100 and 102 forming rotational guides for the rod 68.

Arms 104 and 106 are bolted to the blocks 92 and 94, and extend upwardly to respective cam followers 108 and 110 located within respective inclined cam tracks 112 and 114 in a cam 116. As the rod 68 is rotated to adjust the blocks 92 and 94 horizontally, the fixed arms 104 and 106 cause their cam followers 108 and 110 to traverse the inclined cam tracks 112 and 114. This raises or lowers the entire framework 98, thus raising or lowering the forming sections 48 and 50 at the same time as the sections are horizontally displaced. The inclinations of the cam tracks 112 and 114 determine the amount of vertical adjustment of the forming sections 48 and 50.

In either form of the invention, the rod 68 is secured through a quick disconnect 118 to a further rod section 120 extending from a rotary actuator 122. The actuator 122 is therefore utilized to rotate the rod 68 via the disconnect 118 and rod section 120 to alter the positions of the forming sections 48 and 50, and therefore alter the internal dimensions of the forming body 46.

Figure 3:
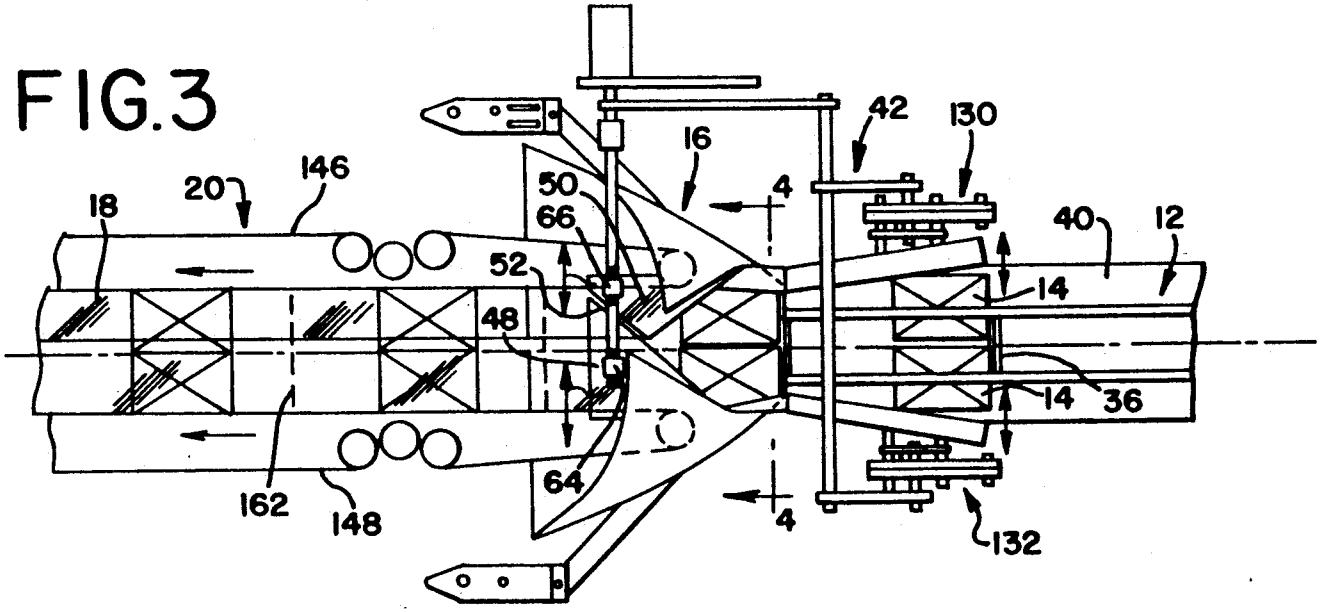
FIG. 3 is a top plan view, similar to FIG. 2, but showing in some detail the adjustable girth former of the present invention.
Figure 4:
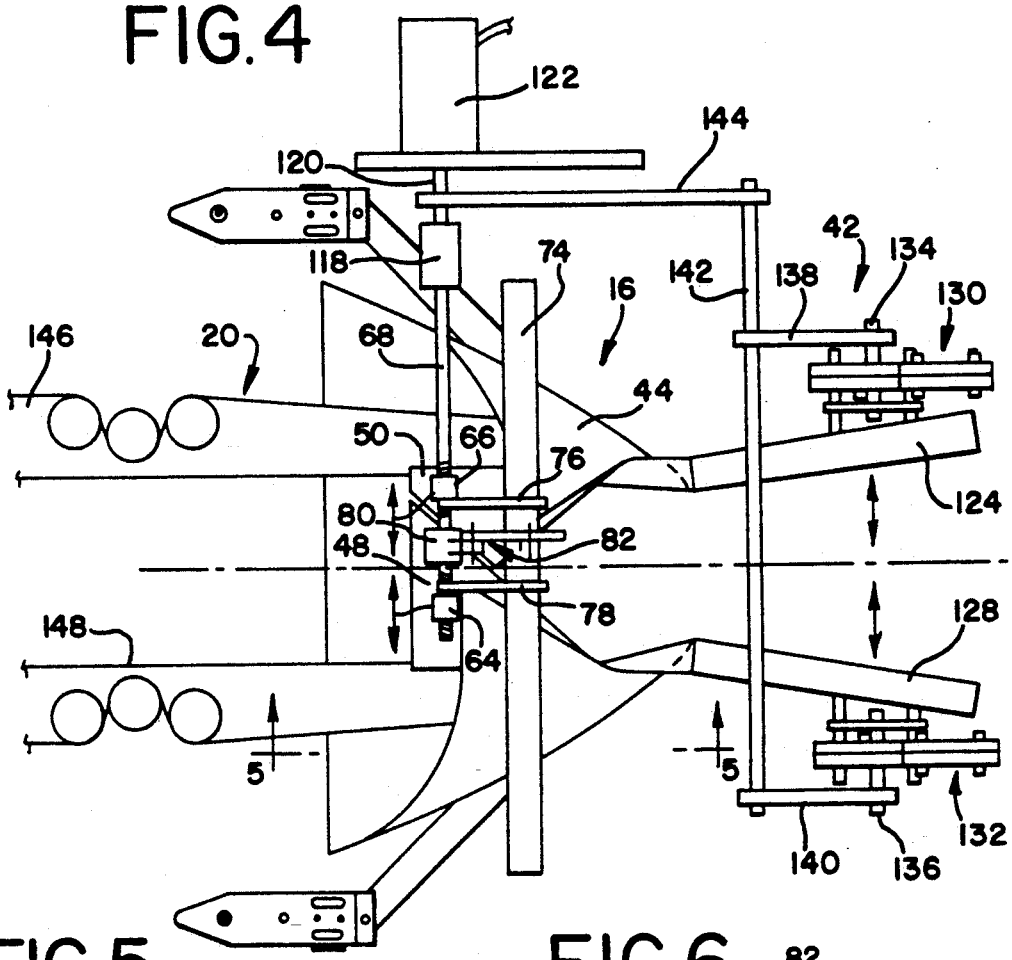
FIG. 4 is a somewhat enlarged view of the girth former shown in FIG. 3, illustrating additional detail, but with the inlet overhead conveyor removed and with all product eliminated.
Figure 5:
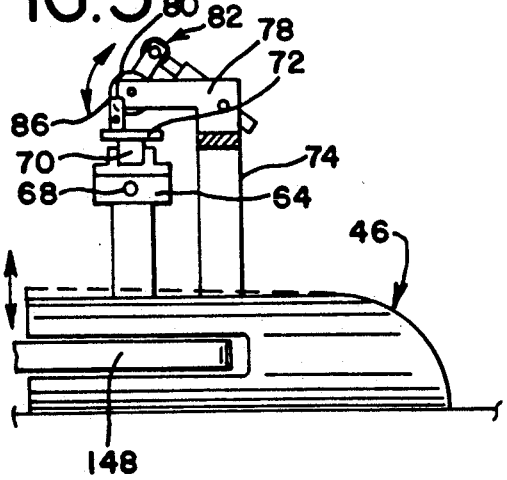
FIG. 5 is a side elevational view taken along lines B—B of FIG. 4, with the forming skirt or shoulder eliminated.
Figure 6:
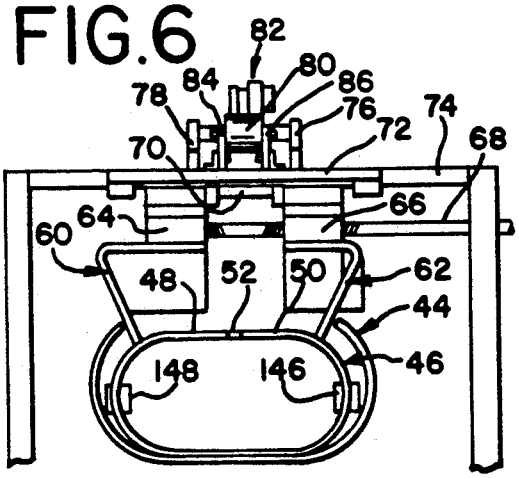
FIG. 6 is an elevational view taken along lines A—A of FIG. 3, and somewhat enlarged.

The preformer 42 as best shown in FIG. 4 includes a pair of side forming members 124 and 128 which are laterally adjustable. A bracket assembly 130 is attached to an outer side of the forming member 124, and a similar bracket assembly 132 is attached to an outer side of the forming member 128. The respective bracket assemblies 130 and 132 carry rods 134 and 136 which extend to respective braces 138 and 140. The braces 138 and 140 are, in turn, threadedly engaged on a rotatable rod 142. The rod 142 extends to a belt 144 which, as illustrated in FIGS. 3 and 4, passes about the rod section 120. Thus, when the rotary actuator 122 is activated, rotation of the rod 120 also rotates the rod 142, drawing the braces 138 and 140 and attached bracket assemblies 130 and 132 toward and away from one another, thus adjusting the side forming members 124 and 128 in the same fashion. Preferably, the belt 144 is in the form of a chain extending about sprockets mounted on the rods 120 and 142.

The pull belt section 20 comprises a pair of pull belts 146 and 148. The pull belts 146 and 148 extend into longitudinal cuts in the forming body 46, and are laterally adjustable (means not illustrated) to accommodate varying sizes of rolls passing therebetween. As shown in FIG. 1, the pull belts have spaced holes in them, and vacuum apparatus 150 and 152 is utilized in a conventional fashion when necessary to aid in conveying of encapsulated rolls 14.

The rotary actuator 122 can be manually activated, or can be automatically activated depending on the sizes of upstream rolls 14 entering the girth forming apparatus 16. To this end, a sensor 154 (FIG. 1) is located to sense the dimensions of rolls 14. The sensed dimensions are transmitted to a microprocessor 156 connected to operate the actuator 122. The microprocessor 156 can be programmed in a conventional fashion in many manners to actuate the rotary actuator 122 dependent upon the sizes of the rolls sensed by the sensor 154. For example, the microprocessor 156 can compute a running average of the sizes of the rolls 14, and based upon that running average, activate the actuator 122 to increase or decrease the internal dimension of the forming body 46. Other means of sensing and activation of the rotary actuator 122 can also be used.

In operation, in the illustrated form of the invention pairs of rolls 14 are introduced by the overhead conveying apparatus 12 to the preformer 42. The rolls 14 are slightly compressed in the preformer 42, and are then introduced into the forming body 46. At the same time, the film 18 emanates from a source in a conventional fashion (not illustrated), extending about and being formed by the shoulder 44, and also entering the forming body 46, encapsulating the rolls 14 therebetween. A heat sealer 158 seals the overlapping film into a tube. The pull belt section 20 pulls the rolls and film through the forming apparatus 16, sending the now-sealed tube between a pair of rotary paddles 160. Preferably, the film 18 is pre-perforated as at 162 (FIGS. 2 and 3), and the paddles 160 are synchronously operated to contact the tube at the perforations 162. Downstream pull belts 164 and 166, operating at a slightly greater surface velocity than that of the pull belts 146 and 148, work in conjunction with the rotary paddles 160 to severe succeeding partial packages 22 from the oncoming tube. The partial package 22 is then end sealed downstream (means not illustrated) in a conventional fashion.

The invention solves a vexing problem of the prior art, and that is accommodation of varying sizes of the rolls 14 as the apparatus 10 is operated. Depending on the size of the gap 52, the forming sections 48 and 50 can be adjusted over a relatively large range to accommodate varying roll sizes.

While a preferred form of the invention has been shown in the drawings and described above it will be evident that the invention can assume different forms. Various widths and lengths of packages can be accommodated, not just individual packages of two rolls as shown. Various changes can be made to the invention without departing from the spirit thereof or scope of the following claims.

What is claimed is:

1. An adjustable girth control for a tube former in a packaging apparatus in which products comprising individual rolls or groups of rolls are conveyed continuously one after another and are packaged in a film, the tube former being situated to continuously form a sheet of film passing through the tube former into a tube encapsulating and transferring succeeding product, the adjustable grith control comprising a. A forming body in the tube former, said forming body being shaped to internally accept and envelope product and film passing therethrough, said forming body having opposed adjustable forming elements defining a variable width gap between said forming elements, and b. means secured to said forming elements for shifting the position of said forming elements to vary internal dimensions of said forming body.

2. An adjustable girth control according to claim 1 in which each forming element comprises a section of said forming body, and in which said shifting means includes means for horizontally displacing said sections and means for vertically displacing said sections.

3. An adjustable girth control according to claim 2 in which said means for horizontally displacing said sections comprises a slide assembly having a slide element secured to each forming body section, and including means for drawing said slide elements toward and away from one another to vary the width of said gap.

4. An adjustable girth control according to claim 3 in which said means for drawing said slide elements comprises a threaded bore in each slide element, said bores being in alignment and threading in one bore being formed opposite to threading in the other bore, and including a threaded rod engaged in said bores, said rod having threading complementary to the threading in said bores, and further including means for rotating said rod.

5. An adjustable girth control according to claim 4 in which said rotating means comprises a rotary actuator, and including means for automatically activating said actuator to rotate said rod.

6. An adjustable girth control according to claim 5 in which said means for automatically activating said actuator comprises a processor, said processor being connected to and receiving signals from an upstream sensor positioned to sense dimensions of product entering said forming body.

7. An adjustable girth control according to claim 3 in which said means for vertically displacing said sections includes camming means for raising and lowering said slide elements as said gap is varied.

8. An adjustable girth control according to claim 7 in which said camming means comprises a pair of spaced inclined cams, and including a cam follower in each cam, each follower being secured to an arm, with one arm being affixed to one slide element and the other arm being affixed to the other slide element.

9. An adjustable girth control according to claim 1 including a preformer located at and in alignment with an upstream end of said forming body.

10. An adjustable girth control control according to claim 9 in which said preformer includes a pair of side forming members, and including means attached to said side forming members for adjusting said side forming members toward and away from one another.

11. An adjustable girth control according to claim 10 including means for simultaneously activating said means for shifting and said means for adjusting.

12. An adjustable girth control according to claim 1 in which each forming element includes a movable section, each section extending from a flex location formed in said forming body.

13. An adjustable girth control according to claim 1 in which each flex location comprises a slit.

14. An adjustable girth control according to claim 1 in which said gap extends in said forming body at an oblique angle to the direction of travel of product through said forming body.

15. An adjustable girth control according to claim 1 including a fired film directing skirt associated with said forming body aligned with an inlet end of said forming body.

* * * * *